US009347276B2

(12) United States Patent
Paros et al.

(10) Patent No.: US 9,347,276 B2
(45) Date of Patent: May 24, 2016

(54) TWO PRONG ROTARY DRILL BIT WITH CUTTING INSERT HAVING EDGE PREPARATION

(71) Applicant: Kennametal Inc., Latrobe, PA (US)

(72) Inventors: Nicholas J. Paros, Johnstown, PA (US); Stephen M. George, Greensboro, NC (US); Glenn W. Sheffler, Blairsville, PA (US); Don C. Rowlett, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 439 days.

(21) Appl. No.: 13/871,009

(22) Filed: Apr. 26, 2013

(65) Prior Publication Data

US 2014/0318872 A1 Oct. 30, 2014

(51) Int. Cl.
*E21B 10/58* (2006.01)
*E21B 10/42* (2006.01)

(52) U.S. Cl.
CPC *E21B 10/58* (2013.01); *E21B 10/42* (2013.01)

(58) Field of Classification Search
CPC ..... E21B 10/58; E21B 10/42; E21B 10/54
See application file for complete search history.

(56) References Cited

U.S. PATENT DOCUMENTS 2,689,108 A 9/1954 Haglund
2,740,611 A * 4/1956 Bowen ..... 175/420.1
3,006,424 A 10/1961 Dahlin et al.
3,671,075 A 6/1972 Eyre et al.
4,026,372 A 5/1977 Hampson
4,120,601 A 10/1978 Benjamin
4,143,920 A 3/1979 Haddock
4,189,013 A 2/1980 Adams et al.
4,194,790 A 3/1980 Kenny et al.
4,449,864 A 5/1984 Haque et al.
4,550,791 A 11/1985 Isakov
4,603,751 A 8/1986 Erickson
4,616,963 A 10/1986 Habert et al.
4,667,755 A 5/1987 Muller et al.
4,674,802 A 6/1987 McKenna et al.
4,678,237 A 7/1987 Collin
4,787,464 A 11/1988 Ojanen
4,817,742 A 4/1989 Whysong
4,838,366 A * 6/1989 Jones ..... 175/426
4,903,609 A 2/1990 Isakov et al.

(Continued)

FOREIGN PATENT DOCUMENTS

DE 2619335 11/1977
DE 3315624 11/1984

(Continued)

*Primary Examiner* — Brad Harcourt
(74) *Attorney, Agent, or Firm* — Larry R. Meenan

(57) ABSTRACT

A two-prong rotary drill bit for engaging an earth strata material includes a drill bit body having an axis of rotation, the drill bit body having a head portion at an axial forward end and a shank portion at an axial rearward end, the head portion having two mounting arms offset from the axis of rotation of the drill bit body. The two-prong rotary drill bit also includes a cutting insert attached to each mounting arm at the axial forward end of the drill bit body. Each cutting insert includes a leading face facing in the direction of rotation, a top surface having a relief surface, a T-land surface extending between the leading face and the relief surface of the top surface and a cutting edge formed at the intersection of the T-land surface and the relief surface of the top surface.

20 Claims, 4 Drawing Sheets

(56) References Cited

U.S. PATENT DOCUMENTS

| | | | |
|---|---|---|---|
| 4,913,125 | A | 4/1990 | Bunting et al. |
| 4,984,944 | A | 1/1991 | Pennington, Jr. et al. |
| 4,998,574 | A | 3/1991 | Beach et al. |
| 5,141,367 | A | 8/1992 | Beeghly et al. |
| 5,147,158 | A | 9/1992 | Riviere |
| 5,172,775 | A | 12/1992 | Sheirer et al. |
| 5,184,689 | A | 2/1993 | Sheirer et al. |
| 5,220,967 | A | 6/1993 | Monyak |
| 5,297,853 | A | 3/1994 | Sollami |
| 5,319,855 | A | 6/1994 | Beevers et al. |
| 5,375,672 | A | 12/1994 | Peay et al. |
| 5,400,861 | A | 3/1995 | Sheirer |
| 5,452,628 | A | 9/1995 | Montgomery, Jr. et al. |
| 5,467,837 | A | 11/1995 | Miller et al. |
| 5,482,124 | A | 1/1996 | Haussmann et al. |
| 5,996,715 | A | 12/1999 | Peay et al. |
| 6,053,263 | A | 4/2000 | Meiners |
| 6,145,606 | A | 11/2000 | Haga |
| 6,173,798 | B1 | 1/2001 | Bryant et al. |
| 6,174,111 | B1 | 1/2001 | Anjanappa et al. |
| 6,260,637 | B1 | 7/2001 | Haussmann et al. |
| 6,260,638 | B1 | 7/2001 | Massa et al. |
| 6,270,164 | B1 | 8/2001 | Seitle et al. |
| 6,270,297 | B1 | 8/2001 | Fang et al. |
| 6,446,741 | B1 | 9/2002 | Kersten et al. |
| 6,595,305 | B1 | 7/2003 | Dunn et al. |
| 6,860,344 | B2 | 3/2005 | Bise et al. |
| 6,945,340 | B2 | 9/2005 | Bise et al. |
| 6,976,549 | B2 | 12/2005 | Haussmann et al. |
| 7,001,120 | B2 | 2/2006 | Moser et al. |
| 7,168,511 | B2 | 1/2007 | Woods et al. |
| 7,393,061 | B2 | 7/2008 | Hesse et al. |
| 7,401,667 | B2 | 7/2008 | Duscha et al. |
| 7,455,129 | B2 | 11/2008 | Widmann et al. |
| 7,578,080 | B2 | 8/2009 | Stoetzer et al. |
| 8,002,054 | B2 | 8/2011 | Swope et al. |
| 8,020,591 | B2 | 9/2011 | Kappel et al. |
| 8,136,887 | B2 | 3/2012 | Hall et al. |
| 8,789,894 | B2 | 7/2014 | Lucek et al. |
| 9,085,947 | B2 | 7/2015 | George et al. |
| 2003/0077134 | A1 | 4/2003 | Moser et al. |
| 2003/0159855 | A1 | 8/2003 | Haussmann et al. |
| 2004/0089481 | A1 | 5/2004 | Bise et al. |
| 2006/0065446 | A1 | 3/2006 | Woods et al. |
| 2007/0151769 | A1 | 7/2007 | Slutz et al. |
| 2007/0169965 | A1 | 7/2007 | Moser et al. |
| 2010/0187019 | A1 | 7/2010 | Swope et al. |
| 2010/0316456 | A1 | 12/2010 | George |
| 2012/0241223 | A1 | 9/2012 | Bise et al. |
| 2014/0318870 | A1 | 10/2014 | George et al. |
| 2014/0318871 | A1 | 10/2014 | Paros et al. |
| 2014/0318872 | A1 | 10/2014 | Paros et al. |

FOREIGN PATENT DOCUMENTS

| | | |
|---|---|---|
| DE | 19514454 | 10/1996 |
| DE | 202010005228 | 10/2011 |

* cited by examiner

TWO PRONG ROTARY DRILL BIT WITH CUTTING INSERT HAVING EDGE PREPARATION

BACKGROUND OF THE INVENTION

The invention pertains generally to an excavating tool such as, for example, a rotary drill bit useful for drilling through various earth strata. More specifically, the invention pertains to a two prong rotary drill bit with a cutting insert such as, for example, a roof drill bit useful for drilling bore holes in an underground mine.

The expansion of an underground mine, such as for example, a coal mine, requires digging a tunnel. Initially, this tunnel has an unsupported roof. Because the roof is not supported, there is an increased chance for a mine cave that, of course, adds to the hazards of underground coal mining. Furthermore, an unsupported roof is susceptible to rock and debris falling from the roof. Falling rock and debris can injure workers as well as create hazardous clutter on the floor of the tunnel. In order to support and stabilize the roof in an underground tunnel, bore holes are drilled in the roof, i.e., earth strata.

The apparatus used to drill these holes typically comprises a drill with a long shaft, i.e., drill steel, attached to the drill. A roof drill bit is detachably mounted to the drill steel at the distal end thereof. In certain roof drill bits, one or more hard cutting inserts are mounted on a body of the roof drill bit. The roof drill bit is then pressed against the roof, and the drilling apparatus operated so as to drill a bore hole in the roof. The bore holes extend between about two feet and about twenty feet into the roof depending upon the particular situation. The roof support members, such as roof panels, are then attached to roof bolts. In one alternative procedure, these bore holes are filled with resin and roof bolts are fixed within the bore holes. In another alternative procedure, the roof bolts use mechanical expander shells to affix the roof bolts in the bore holes. The end result of using either procedure is a roof which is supported, and hence, is of much greater stability than the unsupported roof. This reduces the hazards associated with underground mining. The roof bolting process is considered to be an essential underground mining activity.

Roof bolting accounts for the largest number of lost time injuries in underground mining. During the roof bolting process, the roof is unsupported so that it does not have optimum stability. Furthermore, the roof bolting process exerts stresses on the roof so as to further increase the safety hazards during the roof bolting process. Thus, a decrease in the overall time necessary to bore holes reduces the time it takes to complete the roof bolting process. This is desirable since it contributes to the overall speed, efficiency and safety of the roof bolting process. Thus, many solutions have been proposed to decrease the overall time to complete the drilling of the necessary bore holes. For example, roof drilling bits with various cutting inserts and various cutting geometries have been developed. Efforts have also been made to increase the overall useful life of roof drilling bits.

Accordingly, there is a need for improved roof drilling bits that overcome disadvantages, limitations and shortcomings of known roof drilling bits. For example, it would be desirable to provide an improved roof drill bit that facilitates the prompt completion of the roof bolting process. It would also be desirable to provide an improved roof drill bit that has a longer useful life. It would also be desirable to provide an improved roof drill bit that has an increased penetration rate.

SUMMARY OF THE INVENTION

In accordance with an aspect of the invention, a two-prong rotary drill bit for engaging an earth strata material includes a drill bit body having an axis of rotation, the drill bit body having a head portion at an axial forward end and a shank portion at an axial rearward end, the head portion having two mounting arms offset from the axis of rotation of the drill bit body. The two-prong rotary drill bit also includes a cutting insert attached to each mounting arm at the axial forward end of the drill bit body. Each cutting insert includes a leading face facing in the direction of rotation, a top surface having a relief surface, a T-land surface extending between the leading face and the relief surface of the top surface and a cutting edge formed at the intersection of the T-land surface and the relief surface of the top surface.

In accordance with an aspect of the invention, a cutting insert for a two-prong rotary drill bit for engaging an earth strata material includes a leading face facing in the direction of rotation, a top surface having a primary relief surface and a secondary relief surface, a T-land surface extending between the leading face and the primary relief surface of the top surface and a cutting edge formed at the intersection of the T-land surface and the primary relief surface of the top surface.

These and other aspects of the present invention will be more fully understood following a review of this specification and drawings.

DETAILED DESCRIPTION

Figure 1:
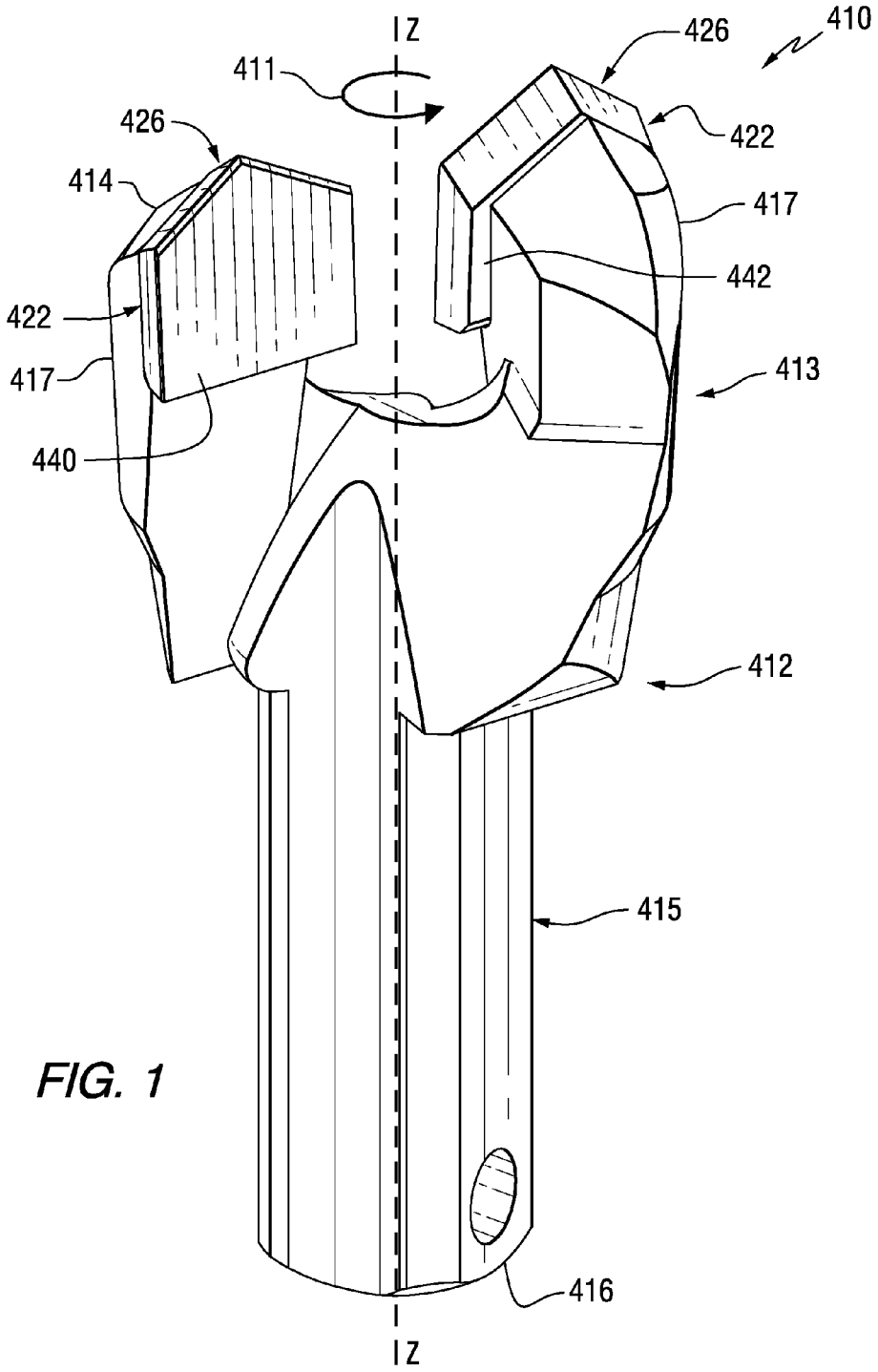
FIG. 1 is an isometric view of a two-prong rotary drilling bit, in accordance with an aspect of the invention.
Figure 2:
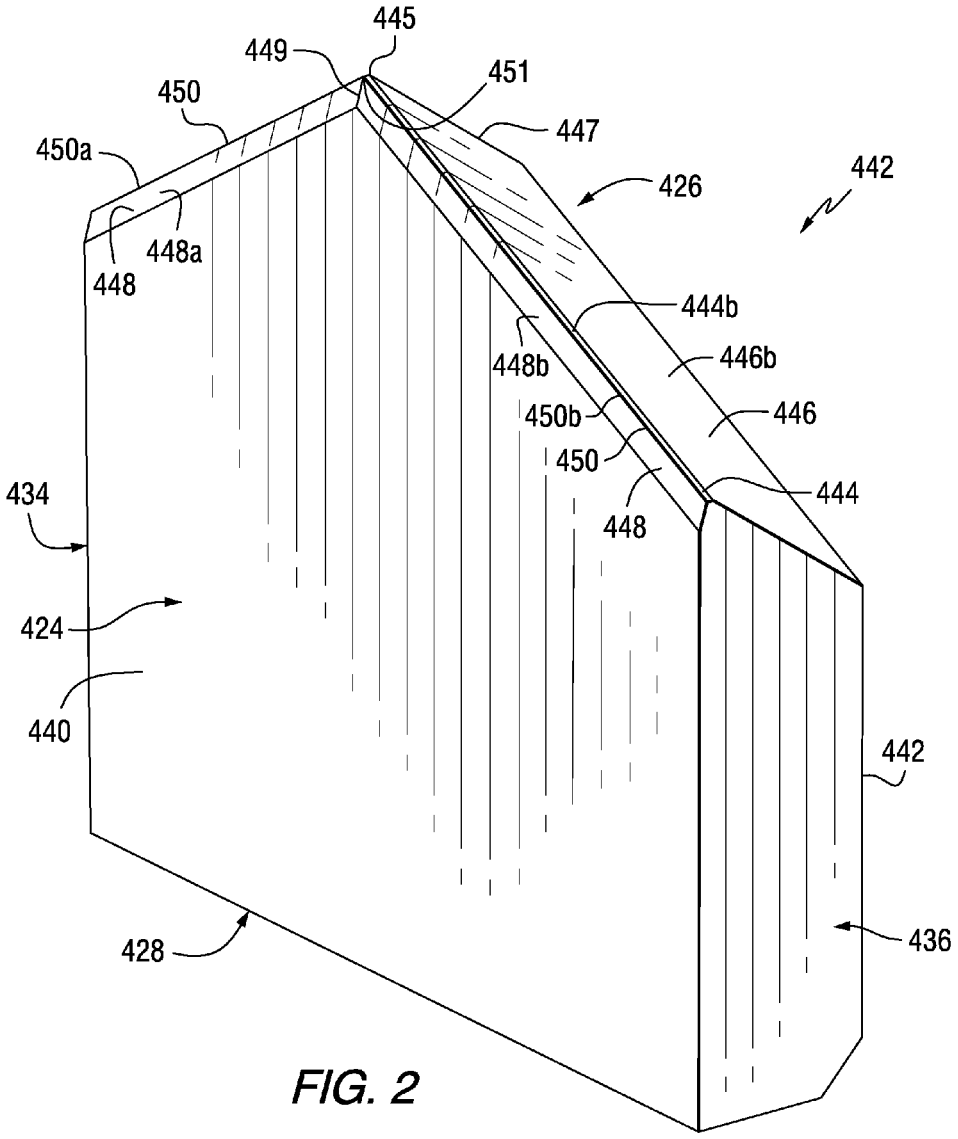
FIG. 2 is an isometric view of one cutting insert shown in FIG. 1, in accordance with an aspect of the invention.

The following description is for purposes of illustrating various aspects of the invention only and not for purposes of limiting the scope of the invention.

Referring to the drawings, FIGS. 1-3A illustrate a two-prong rotary drill bit in the form of a roof drill bit generally designated as 410. Roof drill bit 410 has a drill bit body 412 typically made of, for example, steel. Drill bit body 412 has a central axis of rotation Z-Z and rotates in a direction as indicated by arrow 411. Drill bit body 412 has a head portion 413 at an axial forward end 414 and a shank portion 415 at an axial rearward end 416. The head portion 413 includes two spaced apart mounting arms 417 that are offset from the axis of rotation Z-Z. In one aspect, the roof drill bit 410 may be a wet or dry type roof drill bit. In another aspect, two pronged roof bits may be used for wet drilling for roof and rib bolts and in conventional mining for drill and blast holes.

The roof drill bit 410 also includes a cutting insert (or rotary drill bit insert) 422 attached to each mounting arm 417. Each insert 422 rotates about the central axis of rotation Z-Z of the roof drill bit 410. The insert 422 is typically affixed to the mounting arm 417 by, for example, attaching mechanically or otherwise, via brazing, gluing, or press fitting using conventional compositions and techniques known to those skilled in the art. Each insert 422 is identical and, therefore, for simplicity the description of one insert 422 herein will generally refer to both inserts.

The cutting insert 422 is made from, for example, a cemented tungsten carbide that is a mixture of cobalt and tungsten carbide. Other super hard, wear resistant materials such as polycrystalline diamond, ceramics, or cermet may be used as a supplement and/or substitute. For example chromium carbide-coated metals and other cermets where titanium carbide or vanadium carbide is added to tungsten carbide may be candidates for inserts materials in accordance to aspects of the invention. Alternate ceramics for such applications include aluminum-based, silicon based, zirconium-based and glass varieties. Still other insert materials alternatives include cubic refractory, transition metal carbides or any other known or subsequently developed material(s) harder than the base material. Also coatings of the inserts such as PVD or CVD coatings can be used.

Cutting insert 422 has a cutting insert body, generally designated as 424, that has a top surface generally designated as 426, a bottom surface generally designated as 428, and opposite end surfaces generally designated as 434 and 436. The cutting insert 422 further includes a leading face 440 and an opposite rearward or trailing face 442. The leading face 440 faces generally in the direction of rotation of the roof drill bit 410. In one aspect, the top surface 426 includes a primary relief surface 444. In another aspect, the top surface 426 also includes a secondary relief surface 446 wherein the primary relief surface 444 and the secondary relief surface 446 are contiguous and non-coplanar. In another aspect, the secondary relief surface 446 extends from the primary relief surface 444 toward the rearward or trailing face 442 of the cutting insert 422. In another aspect, the secondary relief surface 446 extends from the primary relief surface 444 to the rearward or trailing face 442.

In accordance with another aspect of the invention, the cutting insert 422 includes edge preparation such as a T-land surface, generally designated as 448, extending generally between the leading face 440 and the primary relief surface 444 of the top surface 426. In one aspect, the T-land surface 448 is a planar surface. In another aspect, the T-land surface 448 is contiguous and non-coplanar with the leading face 440. In another aspect, the T-land surface 448 is contiguous and non-coplanar with the primary relief surface 444. It will be appreciated that the T-land surface 448 may include other than a planar surface, such as, for example it may include a rounded or curved, i.e. non-planar, T-land surface.

The cutting insert 422 further includes a cutting edge 450 formed at the intersection of the T-land surface 448 and the primary relief surface 444 of the top surface 426. In one aspect, the cutting edge 450 may be rounded.

Figure 3:
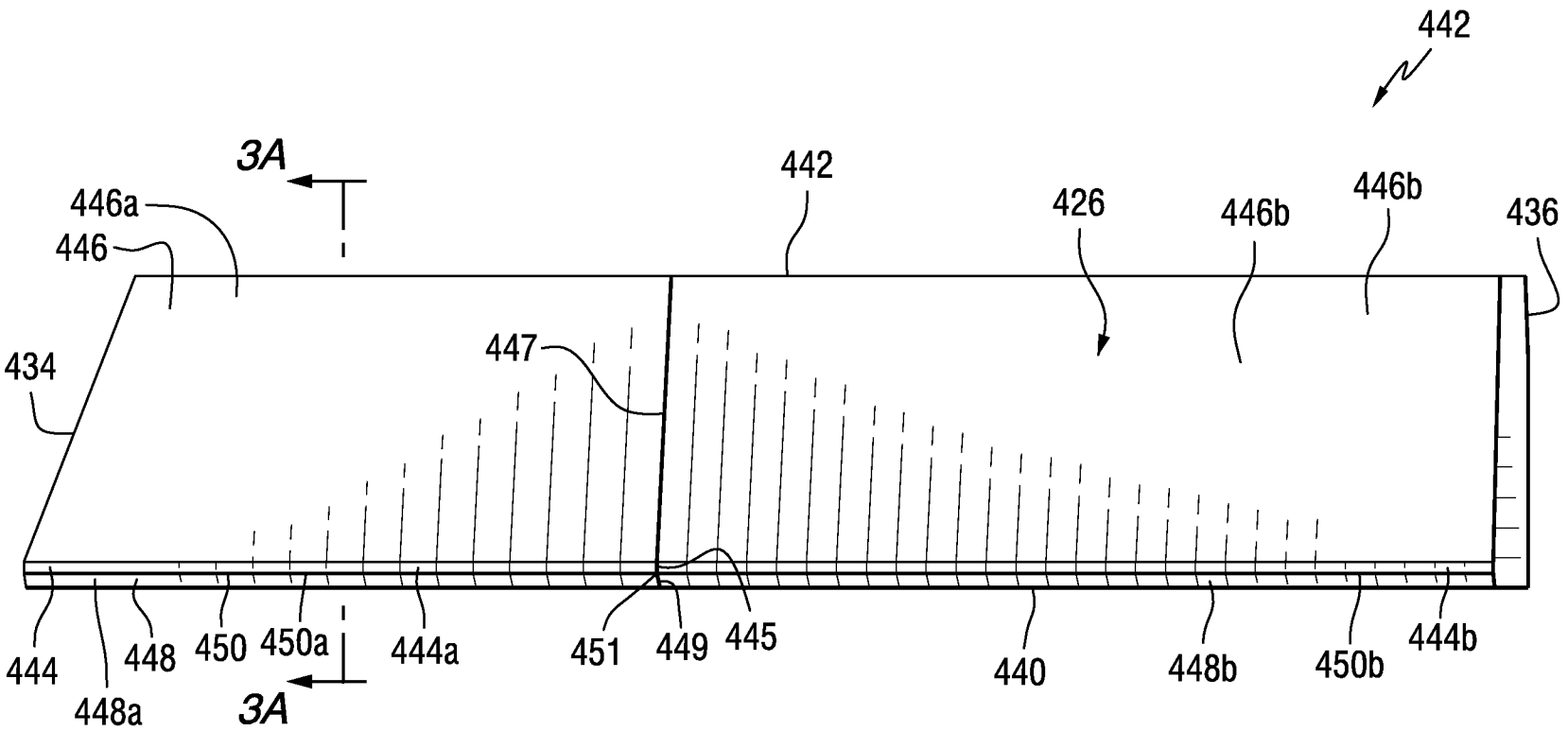
FIG. 3 is a top plan view of the cutting insert shown in FIGS. 1 and 2, in accordance with an aspect of the invention.
Figure 3A:
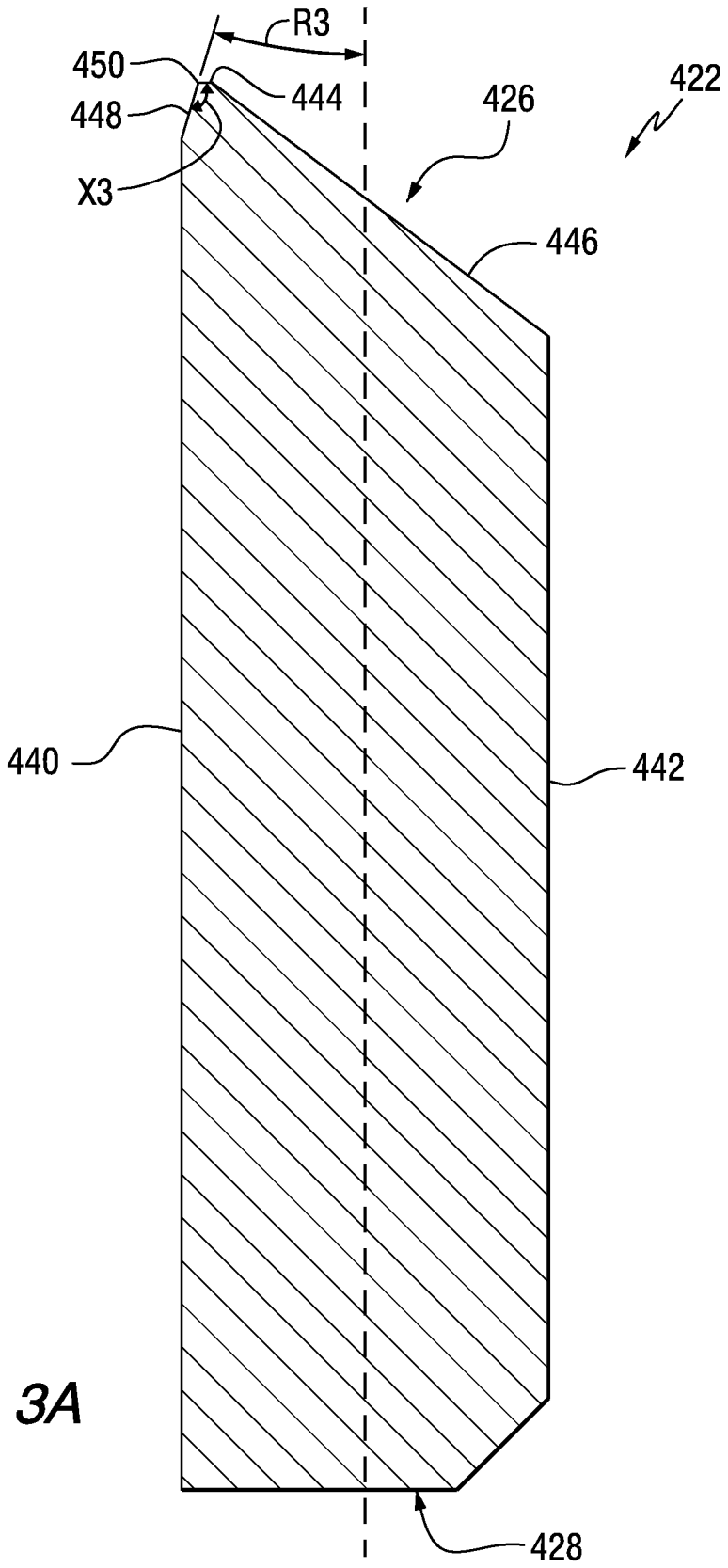
FIG. 3A is a sectional view taken along line 3A-3A of FIG. 3, in accordance with another aspect of the invention.

This configuration of having the cutting edge 450 formed at the intersection of the T-land surface 448 and the primary relief surface 444 provides for the cutting edge 450 to have a negative axial rake angle R3 (see, for example, FIG. 3A). In one aspect, the negative axial rake angle R3 is in the range of about 10 degrees to about 40 degrees. In one specific example, the rake angle R3 shown in FIG. 12A is about negative 25 degrees. It will be appreciated that the cutting edge 450 may include a rounded or curved cutting edge.

The T-land surface 448 is positioned relative to the primary relief surface 444 at an angle X3 (see, for example, FIG. 3A). The angle X3 may be referred to as a relief angle relative to or in relation to cutting edge 450. In one aspect, the T-land surface 448 is positioned relative to the primary relief surface 444 at an angle X3 that is greater than 90 degrees. In one specific example, the angle X3 shown in FIG. 12A is about 115 degrees.

In another aspect, the cutting edge 450 may include a first cutting edge segment 450A and a second cutting edge segment 450B that meet at a cutting apex 451. In another aspect, the T-land surface 448 may include a first T-land segment 448A and a second T-land segment 448B that meet at a T-land apex 449. In another aspect, the primary relief surface 444 may include a first primary relief segment 444A and a second primary relief segment 444B that meet at a primary relief apex 445. In another aspect, the secondary relief surface 446 may include a first secondary relief segment 446A and a second secondary relief segment 446B that meet at a secondary relief apex 447.

It will be appreciated that the described configuration of the T-land 448, cutting edge 450, negative axial rake angle and/or the relief angle individually and/or in combination advantageously avoid a sharp transition for the cutting edge 450 so as to reduce or minimize the possibility of the cutting edge 450 breaking or chipping during operation of the roof drill bit 410.

The Cutting insert 422 is made, for example, with a powder metallurgy process using a press comprising of a die and top and bottom ram/punch to press the complete shape. Parts can be pressed to finished shape or modified with a wet/dry blast, or diamond ground other material shaping processes such as but not limited to EDM (electrical discharge machining), EDG (electrical discharge grinding), green machining, laser ablation into final shapes. Advantageously, the invention provides for moving the critical cutting edge of the insert from the intersection of the die case and ram during manufacturing. In accordance with an aspect of the invention, the critical cutting edge is now formed entirely in the ram/punch. This eliminates the flash from forming on the cutting edge. Flash is undesirable because, for example, it is a stress concentrator. It will be appreciated that these and other aspects of the invention as set forth herein contribute to the desired edge, i.e. cutting edge, preparation for the cutting insert.

Whereas particular aspects of this invention have been described above for purposes of illustration, it will be evident to those skilled in the art that numerous variations of the details of the present invention may be made without departing from the invention as defined in the appended claims.

What is claimed is:

1. A two-prong rotary drill bit for engaging an earth strata material, the two-prong rotary drill bit comprising:

a drill bit body having an axis of rotation, the drill bit body having a head portion at an axial forward end and a shank portion at an axial rearward end, the head portion having two mounting arms offset from the axis of rotation of the drill bit body; and a cutting insert attached to each mounting arm at the axial forward end of the drill bit body, each cutting insert comprising:

a leading face facing in the direction of rotation;

a top surface having a relief surface;

a T-land surface extending between the leading face and the relief surface of the top surface; and a cutting edge formed at the intersection of the T-land surface and the relief surface of the top surface.

2. The two prong rotary drill bit of claim 1, wherein the cutting edge has a negative axial rake angle.

3. The two prong rotary drill bit of claim 2, wherein the negative axial rake angle is in the range of about 10 degrees to about 40 degrees.

4. The two prong rotary drill bit of claim 1, wherein the cutting edge includes a first cutting edge segment and a second cutting edge segment that meet at a cutting apex.

5. The two prong rotary drill bit of claim 4, wherein the T-land surface includes a first T-land segment and a second T-land segment that meet at a T-land apex.

6. The two prong rotary drill bit of claim 5, wherein the relief surface of the top surface includes a primary relief surface that intersects with the T-land surface to form the cutting edge.

7. The two prong rotary drill bit of claim 6, wherein the primary relief surface includes a first primary relief segment and a second primary relief segment that meet at a primary relief apex.

8. The two prong rotary drill bit of claim 7, wherein the relief surface of the top surface further includes a secondary relief surface that extends from the primary relief surface toward a rearward face of the cutting insert.

9. The two prong rotary drill bit of claim 8, wherein the secondary relief surface includes a first secondary relief segment and a second secondary relief segment that meet at a secondary relief apex.

10. The two prong rotary drill bit of claim 8, wherein the primary relief surface and the secondary relief surface are contiguous and non-coplanar.

11. A cutting insert for use in connection with a two prong rotary drill bit for engaging an earth strata material, the cutting insert comprising:

a leading face facing in the direction of rotation;

a top surface having a primary relief surface and a secondary relief surface;

a T-land surface extending between the leading face and the primary relief surface of the top surface; and a cutting edge formed at the intersection of the T-land surface and the primary relief surface of the top surface.

12. The cutting insert of claim 11, wherein the cutting edge has a negative axial rake angle.

13. The cutting insert of claim 12, wherein the negative axial rake angle is in the range of about 10 degrees to about 40 degrees.

14. The cutting insert of claim 12, wherein the T-land surface is positioned relative to the primary relief surface at an angle that is greater than 90 degrees.

15. The cutting insert of claim 14, wherein secondary relief surface extends from the primary relief surface toward a rearward face of the cutting insert and the primary relief surface and the secondary relief surface are contiguous and non-coplanar.

16. The cutting insert of claim 15, wherein the T-land surface and the primary relief surface are contiguous and non-coplanar.

17. The cutting insert of claim 11, wherein the cutting edge includes a first cutting edge segment and a second cutting edge segment that meet at a cutting apex.

18. The cutting insert of claim 17, wherein the T-land surface includes a first T-land segment and a second T-land segment that meet at a T-land apex.

19. The cutting insert of claim 18, wherein the primary relief surface includes a first primary relief segment and a second primary relief segment that meet at a primary relief apex.

20. The cutting insert of claim 19, wherein the secondary relief surface includes a first secondary relief segment and a second secondary relief segment that meet at a secondary relief apex.

* * * * *